US011466334B2

(12) United States Patent
Feng et al.

(10) Patent No.: US 11,466,334 B2
(45) Date of Patent: Oct. 11, 2022

(54) NITROGEN-CONTAINING MICROALLOYED SPRING STEEL AND PREPARATION METHOD THEREOF

(71) Applicants: Shandong Automobile Spring Factory Zibo Co., Ltd., Zibo (CN); Shandong Lianmei Springs Technology Corporation, Zibo (CN)

(72) Inventors: Simon Yisheng Feng, Zibo (CN); Zhenghong Wang, Zibo (CN)

(73) Assignees: Shandong Automobile Spring Factory Zibo Co., Ltd., Zibo (CN); Shandong Lianmei Springs Technology Corporation, Zibo (CN)

( * ) Notice: Subject to any disclaimer, the term of this patent is extended or adjusted under 35 U.S.C. 154(b) by 150 days.

(21) Appl. No.: 16/642,509

(22) PCT Filed: Apr. 8, 2018

(86) PCT No.: PCT/CN2018/082189
§ 371 (c)(1),
(2) Date: Feb. 27, 2020

(87) PCT Pub. No.: WO2019/080457
PCT Pub. Date: May 2, 2019

(65) Prior Publication Data

US 2020/0190614 A1 Jun. 18, 2020

(30) Foreign Application Priority Data

Oct. 26, 2017 (CN) ..... 201711013224.6

(51) Int. Cl.

| | |
|---|---|
| ***C21D 9/02*** | (2006.01) |
| ***C21D 6/00*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |

(52) U.S. Cl.
CPC ..... *C21D 9/02* (2013.01); *C21D 6/004* (2013.01); *C21D 6/005* (2013.01); *C21D 6/008* (2013.01); *C22C 33/04* (2013.01); *C22C 38/001* (2013.01); *C22C 38/02* (2013.01); *C22C 38/04* (2013.01); *C22C 38/44* (2013.01); *C22C 38/46* (2013.01); *C22C 38/48* (2013.01)

(58) Field of Classification Search
CPC ..... C21D 9/02
See application file for complete search history.

(56) References Cited

U.S. PATENT DOCUMENTS 5,776,267 A * 7/1998 Nanba ..... C22C 38/44 148/328
2005/0271496 A1* 12/2005 Torizuka ..... B21K 1/46 411/424
2009/0277539 A1* 11/2009 Kimura ..... C21D 9/525 148/504

FOREIGN PATENT DOCUMENTS

CN 105112774 * 12/2015
KR 101353552 * 1/2014

* cited by examiner

*Primary Examiner* — Nicholas A Wang
(74) *Attorney, Agent, or Firm* — Bayramoglu Law Offices LLC

(57) ABSTRACT

A nitrogen-containing microalloyed spring steel and a preparation method thereof are provided. The chemical components are: 0.45-0.52% of carbon, 0.15-0.35% of silicon, 0.90-1.10% of manganese, 0.90-1.15% of chromium, 0.10-0.25% of molybdenum, 0.10-0.20% of vanadium, 0.025-0.04% of niobium, 0.007-0.012% of nitrogen, less than or equal to 0.03% of lead, tin, zinc, antimony, and bismuth, less than or equal to 25 ppm of oxygen and hydrogen, less than or equal to 0.02% of sulfur and phosphorus, less than or equal to 0.2% of copper, less than or equal to 0.35% nickel, and a balance of iron. The spring steel has significantly improved properties, including high mechanical strength, large elongation, high reduction of area, and good anti-fatigue performance.

10 Claims, No Drawings

NITROGEN-CONTAINING MICROALLOYED SPRING STEEL AND PREPARATION METHOD THEREOF

CROSS REFERENCE TO THE RELATED APPLICATIONS

This application is the national phase entry of International Application No. PCT/CN2018/082189, filed on Apr. 8, 2018, which is based upon and claims priority to Chinese Patent Application No. 201711013224.6, filed on Oct. 26, 2017, the entire contents of which are incorporated herein by reference.

TECHNICAL FIELD

The present invention relates to a spring steel, and more specifically to a nitrogen-containing microalloyed spring steel and a preparation method thereof.

BACKGROUND

A spring is one of the basic parts and components for manufacturing devices. The expansion of its scale and variety and the improvement of its quality level are the prerequisites to ensure the improvement of the performance of the main machine of a mechanical device. However, the industrial structure of the spring industry in China has long been in a passive situation of over-supply low-grade ordinary springs and short-supply high-end products (high strength, high stress, special-shaped parts, and special materials). Spring products can no longer fully meet the development needs of the high-end equipment manufacturing industry. Suspension springs, valve springs, and clutch springs for automobiles and high-end springs for locomotive, machinery, electric power, military, and other industries still need to be imported. In addition, there is still a gap between the current spring products made in China currently and similar foreign products in performance. For example, there are gaps in spring load accuracy, verticality accuracy, and other aspects, which are mainly reflected in unstable performance, large dispersion of some key quality indicators, and unstable service life. Especially when main machines require springs to work under high speed and high stress conditions, the contradiction is more serious.

A spring steel refers to a steel that is specifically used for manufacturing springs and elastic elements due to its elasticity in quenched and tempered states. According to chemical composition, the spring steel is divided into a non-alloy spring steel (carbon spring steel) and an alloy spring steel. Especially in consideration of the lightweighting of automobiles, the development of a spring steel with improvements in high strength, high elongation, high reduction of area, and fatigue resistance is highly desirable.

SUMMARY

For the drawbacks of the prior art, the objective of the present invention is to provide a nitrogen-containing microalloyed spring steel, which has the advantages of high mechanical strength, large elongation, high reduction of area, and good fatigue resistance. The present invention further provides a method for preparing the nitrogen-containing microalloyed spring steel, which is scientific, reasonable, simple and practicable.

A nitrogen-containing microalloyed spring steel in the present invention includes the following chemical components in a mass ratio:

Carbon (C): 0.45-0.52%; Silicone (Si): 0.15-0.35%; Manganese (Mn): 0.90-1.10%; Chromium (Cr): 0.90-1.15%; Molybdenum (Mo): 0.10-0.25%; Vanadium (V): 0.10-0.20%; Niobium (Nb): 0.025-0.04%; Nitrogen (N): 0.007-0.012%; Lead (Pb), Tin (Sn), Zinc (Zn), Antimony (Sb), and Bismuth (Bi)≤0.03%; Oxygen ($O_2$) and Hydrogen ($H_2$)≤25 ppm; Sulfur (S) and Phosphorus (P)≤0.02%; Copper (Cu)≤0.2%; Nickel (Ni)≤0.35%; and a balance of Iron (Fe).

The dosage standards and functions of each of the chemical components are as follows.

C: 0.45-0.52 wt. %.

Through solid-solution strengthening, carbon improves the elastic strength, hardness and wear resistance of the spring steel, but reduces the plasticity, toughness and fatigue strength of the spring steel. When C is controlled within 0.45-0.52 wt. % with other alloy elements, an optimal combination with strength, fatigue life, and economic benefits can be obtained. In the present invention, the content of C used is much less than that in conventional spring steels, which can change the structure and morphology of martensite and improve the toughness of the spring steel.

Si: 0.15-0.35 wt. %.

Through solid-solution strengthening of ferrite, silicon improves the elasticity of the steel, but reduces the plasticity and toughness of steel and dramatically increases the tendency of decarburization and graphitization, resulting in a generation of inclusions and a deterioration of the fatigue performance of the spring. Therefore, in the present invention, it is found that when the content of Si is controlled within 0.15-0.35 wt. %, the influence on the fatigue strength is the lowest. The content of Si in the present invention is much less than that in conventional spring steels, which can reduce the carbon-repellency, thereby reducing decarburization.

Mn: 0.90-1.10 wt. %.

Mn can improve the strength of the steel through a solution treatment and simultaneously improve the hardenability of the steel. However, excessive Mn may promote temper brittleness. Therefore, the content of Mn needs to be controlled to be 0.90-1.10 wt. %.

Cr: 0.90-1.15 wt. %.

Through a solution treatment, chromium improves the strength, hardenability and tempering stability of the steel, which is conducive to improve the performance and disperse precipitation of the spring steel. However, excessive chromium tends to form chromium carbides, which reduces the plasticity and toughness of the steel. Therefore, the content of Cr is controlled to be 0.90-1.15 wt. %.

Mo: 0.10-0.25 wt. %.

Through a solution treatment, Mo improves the strength of the steel, greatly improves the hardenability of the steel, and stabilizes the carbon element, which is beneficial to improve the strength of the spring steel. However, excessive Mo may change the quenching curve of the steel and tend to form feathery bainite, which adversely affects the fatigue strength of the spring steel. Therefore, the content of Mo needs to be controlled to be 0.10-0.25 wt. %.

As for V and Nb, V: 0.10-0.20 wt. %, and Nb: 0.025-0.04 wt. %.

V and Nb form finely dispersed VC, NbC, VN, or NbN in the steel, which greatly strengthens the matrix, refines the grain boundaries, and stops the growth of grains. Therefore, a fine and high-strength structure can be obtained, which greatly improves the strength and fatigue performance of the spring steel. However, when a single element is excessive, the grains tend to be coarsened and lose their desirable functions. Therefore, in the present invention, the overall function of the two elements is used. After optimization, the optimal content is V: 0.10-0.20 wt. %; and Nb: 0.025-0.04 wt. %.

N: 0.007-0.012 wt. %.

Nitrogen acts similarly to carbon in the steel. Nitrogen improves the elasticity, strength and hardness of the steel through a stronger solid solution strengthening. However, the weakening effect of nitrogen on the plasticity, toughness and fatigue strength of the spring steel is smaller than that of carbon. Especially, the formed martensite has a Fe—C—N structure, which has higher fatigue strength. The nitrogen-containing microalloyed spring steel has higher strength, toughness and fatigue life. The content of N is 70-120 ppm, which is the optimum content of N determined in the present invention.

S and P≤0.02 wt. %.

Inclusions such as S and P are inevitably presented in the steel, and S, P, and alloy elements form inclusions such as MnS and other inclusions, which not only offset the advantages of the alloy elements, but also allows S and P to cause segregation, weakening the toughness of the steel, and becoming a source of fatigue cracks, which may significantly reduce the fatigue strength of the spring. Therefore, the contents of S and P in the steel should be strictly controlled within 0.02 wt. %.

Cu≤0.2 wt. %.

Since the spring needs to be subjected to a subsequent thermal processing, Cu will significantly reduce the thermoplasticity of the material and tend to cause microcracks during forging, which can seriously affect the strength of the spring. Therefore, the content of Cu should be strictly controlled. Because scrap materials contain copper wires, the usage amount of Cu in the scrap materials should be strictly controlled to be less than or equal to 0.2 wt. % in the steel material.

Ni≤0.35 wt. %.

Nickel can improve the strength and toughness of the steel, reduce the brittle transition temperature, and especially improve the hardenability. Due to the cost of nickel, however, other alloys are used to the extent possible to meet performance requirements.

The spring steel of the present invention has a thickness of 25-38 mm.

Through a metallographic examination, it is found that microstructures of the spring steel include merely a ferrite structure and a pearlite structure only without any other structure.

A method for preparing the nitrogen-containing microalloyed spring steel includes: sequentially subjecting a spring steel raw material to smelting, refining, vacuum degassing, and continuous casting and cooling into a steel ingot, and then subjecting the steel ingot to peeling, re-heating continuous rolling, controlled cooling, quenching, and tempering to obtain a spring steel product.

Moreover, the spring steel raw material may include partially a scrap steel. However, the scrap steel contains copper wires and other metals and substances. Therefore, a usage amount of the scrap steel should be controlled to within 20% of a total mass of the spring steel raw material.

The melting is conducted at a temperature of 1630-1700° C. for 25-60 min. The refining is conducted at a temperature of 1500-1550° C. for 20-60 min. Electromagnetic stirring is performed during the refining. The electromagnetic stirring aligns microstructures and makes them uniform.

During the vacuum degassing, a degree of vacuum is less than or equal to 130 Pa.

The continuous casting and cooling into the steel ingot includes: first reducing the temperature to below 1150° C. at a rate of 25-35° C./min, and then naturally cooling to room temperature. Therefore, inclusions are limited on a center line of the steel ingot as much as possible, and after the steel is rolled into a product, the harm to the performance of the product is minimized.

A peeling depth of the steel ingot is at least 3.0 mm.

The re-heating continuous rolling has a starting rolling temperature of 900-1100° C. and a final rolling temperature of 850-900° C. Therefore, the rolling is conducted in an austenite region, the maximum deformation properties of the material are achieved, and the favorable conditions are provided for subsequent cooling.

The controlled cooling is specifically conducted as follows: first fast cooling to 600° C., and then slow cooling to room temperature; a speed of the fast cooling is greater than or equal to 30° C./min, and a speed of the slow cooling is less than or equal to 10° C./min. In this way, decarburization of the surface can be avoided and a lower hardness can be maintained to facilitate subsequent shear processing.

The quenching method is an oil quenching with a quenching temperature of 850-900° C., a holding time of 1.0-1.5 min/mm, and a tempering temperature of 400-500° C.

Further, in the preparation process of the microalloyed spring steel of the present invention, the raw materials are put in a converter, and a mass content of the scrap steel in the raw materials is controlled within 20%. In order to control the content of impurities, the electromagnetic stirring and vacuum degassing are performed to make the fiber structure uniform with fewer bubbles, fewer pores, and an overall more dense structure. After the vacuum degassing, the continuous casting is performed to form a stable macrostructure. The heating continuous rolling is performed to ensure the uniform size of the structure. The cooling temperature is controlled to reduce the decarburization layer and ensure the shear hardness. After cooling to room temperature, the quenching and tempering are performed to obtain a finished product.

Compared with the prior art, the present invention has the following advantages.

(1) The properties of the nitrogen-containing microalloyed spring steel prepared by the present invention are as follows:

the hardness of the raw material is less than or equal to HB330, the tensile strength after a heat treatment can reach about 1800 MPa, the yield strength can reach about 1650 MPa, the elongation rate is greater than or equal to 7%, the reduction of area is greater than or equal to 25%, and the fatigue cycles are greater than 340,000 cycles.

(2) The semi-decarburized layer of the spring steel is less than or equal to 0.20 mm, and there is no fully-decarburized layer.

(3) After the heat treatment, the grain size is greater than ASTM class 8.5.

(4) The preparation method in the present invention is scientific, reasonable, simple, and practicable. The use of the electromagnetic stirring and vacuum degassing can reduce bubbles and pores, making the microstructure more uniform and dense.

DETAILED DESCRIPTION OF THE EMBODIMENTS

The present invention is further described hereinafter with reference to the embodiments. All raw materials used in the embodiments are commercially available unless otherwise specified.

Embodiment 1

In one embodiment, the nitrogen-containing microalloyed spring steel is prepared as follows. Molten iron is added to a 120-ton converter and smelted at 1680° C. for 45 minutes to obtain a steel. Then, 18% scrap steel is added to adjust the temperature to 1650° C. and then transferred to a refining furnace. Under electromagnetic stirring, a ferrosilicon, a ferromanganese, a chromium-molybdenum-iron alloy, a ferrovanadium, a ferroniobium, and manganese nitride are added. After adjusting the chemical composition at 1535±15° C. for 40 minutes, vacuum degassing (under a condition of vacuum degree ≤130 Pa) is performed, and then continuous casting is performed to obtain an ingot blank of 180×180. After cooling to 1150° C. at a rate of 28° C./min, the ingot blank is air-cooled to room temperature and then is peeled. After peeling 3.2 mm in depth, the peeled ingot blank is heated to 1200° C., and then is continuously rolled into a spring strip steel of 30×89 mm, with a starting rolling temperature of 1050° C. and a final rolling temperature of 890° C. After rolling, the spring strip steel is quickly cooled to 600° C. at a rate of 37° C./min, and then slowly cooled to room temperature at a rate of 8° C./min.

Upon repeated testing, the spring strip steel of 30×89 mm obtained by the above method was found to yield the chemical compositions shown in Table 1. The spring strip steel is further processed into two leaf springs. After quenching at 880° C. and tempering at 460° C., tensile specimen processing and tensile tests are performed in accordance with the Chinese national standard GB/T228-2002. Meanwhile, the yield strength, elongation, and reduction of area are tested. The assembled leaf spring is subjected to a fatigue test in accordance with GB/T228-2002. The test results are shown in Table 2.

Embodiment 2

In another embodiment, he nitrogen-containing microalloyed spring steel is prepared as follows.

Molten iron is added to a 120-ton converter and smelted at 1630° C. for 60 minutes to obtain a steel. Then, 18% scrap steel is added to adjust the temperature to 1650° C., and then transferred to a refining furnace. Under electromagnetic stirring, a ferrosilicon, a ferromanganese, a chromium-molybdenum-iron alloy, a ferrovanadium, a ferroniobium, and manganese nitride are added. After adjusting the chemical composition at 1515±15° C. for 60 minutes, vacuum degassing (under a condition of vacuum degree ≤130 Pa) is performed, and then continuous casting is performed to obtain an ingot blank of 180×180. After cooling to 1150° C. at a rate of 30° C./min, the ingot blank is air-cooled to room temperature, and then is peeled. After peeling 3.5 mm in depth, the peeled ingot blank is heated to 1200° C., and then is continuously rolled into a spring strip steel of 30×89 mm, with a starting rolling temperature of 950° C. and a final rolling temperature of 850° C. After rolling, the spring strip steel is quickly cooled to 600° C. at a rate of 35° C./min, and then slowly cooled to room temperature at a rate of 10° C./min.

Upon testing, the spring strip steel of 30×89 mm obtained by the above method was found to have the chemical compositions shown in Table 1. The spring strip steel is further processed into two leaf springs. After quenching at 850° C. and tempering at 480° C., tensile specimen processing and tensile tests are performed in accordance with GB/T228-2002. Meanwhile, the yield strength, elongation, and reduction of area are tested. The assembled leaf spring is subjected to a fatigue test in accordance with GB/T228-2002. The test results are shown in Table 2.

Embodiment 3

In yet another embodiment, the nitrogen-containing microalloyed spring steel is prepared as follows.

Molten iron is added to a 120-ton converter and smelted at 1700° C. for 25 minutes to obtain a steel. Then, 18% scrap steel is added to adjust the temperature to 1650° C., and then transferred to a refining furnace. Under electromagnetic stirring, a ferrosilicon, a ferromanganese, a chromium-molybdenum-iron alloy, a ferrovanadium, a ferroniobium, and manganese nitride are added. After adjusting the chemical composition at 1535±15° C. for 20 minutes, vacuum degassing (under a condition of vacuum degree ≤130 Pa) is performed, and then continuous casting is performed to obtain an ingot blank of 180×180. After cooling to 1150° C. at a rate of 35° C./min, the ingot blank is air-cooled to room temperature, and then the is peeled. After peeling 3.0 mm in depth, the peeled ingot blank is heated to 1200° C., and then continuously rolled into a spring strip steel of 30×89 mm, with a starting rolling temperature of 900° C. and a final rolling temperature of 900° C. After rolling, the spring strip steel is quickly cooled to 600° C. at a rate of 40° C./min, and then slowly cooled to room temperature at a rate of 9° C./min.

Upon testing, the spring strip steel of 30×89 mm obtained by the above method has the chemical compositions shown in Table 1. The spring strip steel is further processed into two leaf springs. After quenching at 900° C. and tempering at 500° C., tensile specimen processing and tensile tests are performed in accordance with GB/T228-2002. Meanwhile, the yield strength, elongation, and reduction of area are tested. The assembled leaf spring is subjected to a fatigue test in accordance with GB/T228-2002. The test results are shown in Table 2.

Comparative Embodiment 1

The chemical compositions of standard steel 9260 are shown in Table 1. The standard steel 9260 is further processed into two leaf springs. After quenching at 900° C. and tempering at 500° C., tensile specimen processing and tensile tests are performed in accordance with GB/T228-2002. The assembled leaf spring is subjected to a fatigue test in accordance with GB/T228-2002. In addition, the yield strength, elongation, and reduction of area are measured. The test results are shown in Table 2.

Comparative Embodiment 2

The chemical compositions of standard steel 5160 are shown in Table 1. The standard steel 5160 is further processed into two leaf springs. After quenching at 900° C. and tempering at 500° C., tensile specimen processing and tensile tests are performed in accordance with GB/T228-2002. The assembled leaf spring is subjected to a fatigue test in accordance with GB/T228-2002. In addition, the yield strength, elongation, and reduction of area are measured. The test results are shown in Table 2.

Comparative Embodiment 3

The chemical compositions of standard steel 6150 are shown in Table 1. The standard steel 6150 is further processed into two leaf springs. After quenching at 900° C. and tempering at 500° C., tensile specimen processing and tensile tests are performed in accordance with GB/T228-2002. The assembled leaf spring is subjected to a fatigue test in accordance with GB/T228-2002. In addition, the yield strength, elongation, and reduction of area are measured. The test results are shown in Table 2.

TABLE 1

Comparison of Chemical Compositions of Embodiments 1-3 and Comparative Embodiments 1-3

| Mark | C | Si | Mn | Cr | Mo | Ni | V | Nb | N |
|---|---|---|---|---|---|---|---|---|---|
| Embodiment 1 | 0.46 | 0.25 | 1.08 | 1.08 | 0.13 | 0.11 | 0.13 | 0.027 | 0.011 |
| Embodiment 2 | 0.48 | 0.20 | 1.02 | 1.03 | 0.15 | 0.13 | 0.15 | 0.033 | 0.010 |
| Embodiment 3 | 0.50 | 0.27 | 0.91 | 1.11 | 0.25 | 0.19 | 0.20 | 0.037 | 0.009 |
| Comparative Embodiment 1 | 0.62 | 1.72 | 0.76 | 0.11 | 0.010 | 0.02 | <0.01 | <0.001 | <0.001 |
| Comparative Embodiment 2 | 0.61 | 0.28 | 0.82 | 0.79 | 0.011 | 0.02 | <0.01 | <0.001 | <0.001 |
| Comparative Embodiment 3 | 0.47 | 0.31 | 0.72 | 0.95 | 0.011 | 0.02 | 0.15 | <0.001 | <0.001 |

TABLE 2

Test Results

| Mark | $Rp_{0.2}$ (MPa) | Rm (MPa) | A (%) | Z (%) | Average fatigue cycle (Cycle) |
|---|---|---|---|---|---|
| Embodiment 1 | 1648 | 1756 | 7.9 | 33 | 341, 217 |
| Embodiment 2 | 1652 | 1783 | 7.8 | 32 | 372, 381 |
| Embodiment 3 | 1657 | 1796 | 7.7 | 31 | 388, 862 |
| Comparative Embodiment 1 | 940 | 980 | 8.2 | 31 | 43, 265 |
| Comparative Embodiment 2 | 980 | 1070 | 8.3 | 32 | 67, 352 |
| Comparative Embodiment 3 | 1030 | 1100 | 8.6 | 34 | 81, 210 |

According to the results, under the conditions of similarity in plasticity, toughness, reduction of area Z, and elongation A, the strength of the spring steel in the present invention, including the yield strength ($Rp_{0.2}$) and the tensile strength (Rm), is significantly improved. In particular, the fatigue strength is increased by more than 400%, which is especially applicable to the manufacturing of lightweight leaf springs.

What is claimed is:

1. A nitrogen-containing microalloyed spring steel, comprising the following chemical components in a mass ratio: 0.45-0.52% of carbon, 0.15-0.27% of silicon, 0.90-1.10% of manganese, 0.90-1.15% of chromium, 0.10-0.25% of molybdenum, 0.10-0.20% of vanadium, 0.025-0.04% of niobium, 0.007-0.012% of nitrogen, less than or equal to 0.03% of sum of lead, tin, zinc, antimony, and bismuth, less than or equal to 25 ppm of sum of oxygen and hydrogen, less than or equal to 0.02% of sum of sulfur and phosphorus, less than or equal to 0.2% of copper, less than or equal to 0.35% nickel, and a balance of iron, wherein microstructures of the nitrogen-containing microalloyed spring steel comprises a distinct ferrite structure and a distinct pearlite structure wherein the spring steel has an elongation of at least 7%, a reduction of area of at least 25%, a tensile strength of at least 1756 MPa, a yield strength of at least 1648 MPa, and an average fatigue cycle of at least about 341,217 cycles.

2. The nitrogen-containing microalloyed spring steel of claim 1, wherein the spring steel is used to make a leaf spring.

3. A method for preparing the nitrogen-containing microalloyed spring steel according to claim 1, comprising: sequentially subjecting a spring steel raw material to a smelting, a refining, a vacuum degassing, and a continuous casting and cooling to obtain a steel ingot, and then subjecting the steel ingot to a peeling, a re-heating continuous rolling, a controlled cooling, a quenching, and a tempering to obtain the nitrogen-containing microalloyed spring steel.

4. The method for preparing the nitrogen-containing microalloyed spring steel according to claim 3, wherein, the smelting is conducted at a temperature of 1630-1700° C. for 25-60 min; the refining is conducted at a temperature of 1500-1550° C. for 20-60 min; an electromagnetic stirring is performed during the refining.

5. The method for preparing the nitrogen-containing microalloyed spring steel according to claim 3, wherein, during the vacuum degassing, a degree of vacuum is equal to or less than 130 Pa.

6. The method for preparing the nitrogen-containing microalloyed spring steel according to claim 3, wherein, the continuous casting and cooling comprises: first reducing a temperature to below 1150° C. at a rate of 25-35° C/min, and then naturally cooling to room temperature.

7. The method for preparing the nitrogen-containing microalloyed spring steel according to claim 3, wherein, in the peeling, the steel ingot is peeled with a depth of at least 3.0 mm.

8. The method for preparing the nitrogen-containing microalloyed spring steel according to claim 3, wherein, the re-heating continuous rolling starts at a temperature of 900-1100° C. and ends at a temperature of 850-900° C.

9. The method for preparing the nitrogen-containing microalloyed spring steel according to claim 3, wherein, the controlled cooling comprises: cooling to 600° C. at a speed of equal to or more than 30° C/min, and then cooling to room temperature at a speed of equal to or less than 10° C/min.

10. The method for preparing the nitrogen-containing microalloyed spring steel according to claim 3, wherein, the quenching is an oil quenching, wherein in the oil quenching, the steel ingot is processed at a temperature of 850-900° C.

for 1.0-1.5 min per millimeter of the steel ingot, and is tempered at a temperature of 400-500° C.

* * * * *